US007743431B2

(12) United States Patent
Mehren et al.

(10) Patent No.: US 7,743,431 B2
(45) Date of Patent: Jun. 29, 2010

(54) J-BAND APPARATUS

(76) Inventors: Erik P. Mehren, 707 Circle Dr., University Park, IL (US) 60466; Reginald J. Burton, Jr., 707 Circle Dr., University Park, IL (US) 60466

( * ) Notice: Subject to any disclaimer, the term of this patent is extended or adjusted under 35 U.S.C. 154(b) by 641 days.

(21) Appl. No.: 11/140,664

(22) Filed: May 31, 2005

(65) Prior Publication Data

US 2006/0150301 A1 Jul. 13, 2006

Related U.S. Application Data

(60) Provisional application No. 60/642,017, filed on Jan. 7, 2005.

(51) Int. Cl.
*A41D 1/06* (2006.01)

(52) U.S. Cl. ..... 2/232

(58) Field of Classification Search ..... 2/232, 2/455, 22, 79, 227, 69, 243.1, 911
See application file for complete search history.

(56) References Cited

U.S. PATENT DOCUMENTS

| | | | | |
|---|---|---|---|---|
| 588,156 | A * | 8/1897 | Lewis | 223/118 |
| 668,051 | A * | 2/1901 | Puffer | 36/70 R |
| 5,625,896 | A * | 5/1997 | LaBarbera et al. | 2/22 |
| 6,205,686 | B1 * | 3/2001 | Davis | 36/138 |
| 6,393,619 | B1 * | 5/2002 | Bardes | 2/232 |
| 6,618,862 | B1 * | 9/2003 | Bunjes | 2/232 |
| 6,938,623 | B2 * | 9/2005 | Graupner et al. | 128/869 |
| 7,041,041 | B1 * | 5/2006 | Evans | 482/126 |

* cited by examiner

*Primary Examiner*—Tejash Patel

(57) ABSTRACT

An apparatus for supporting the ankle-shin area of pant legs having a "W" shaped bar with a first loop and a second loop on each end and a strap having each end connected to each loop respectively. The strap has an adjustment buckle coupled to it for adjusting the tension on the strap.

6 Claims, 5 Drawing Sheets

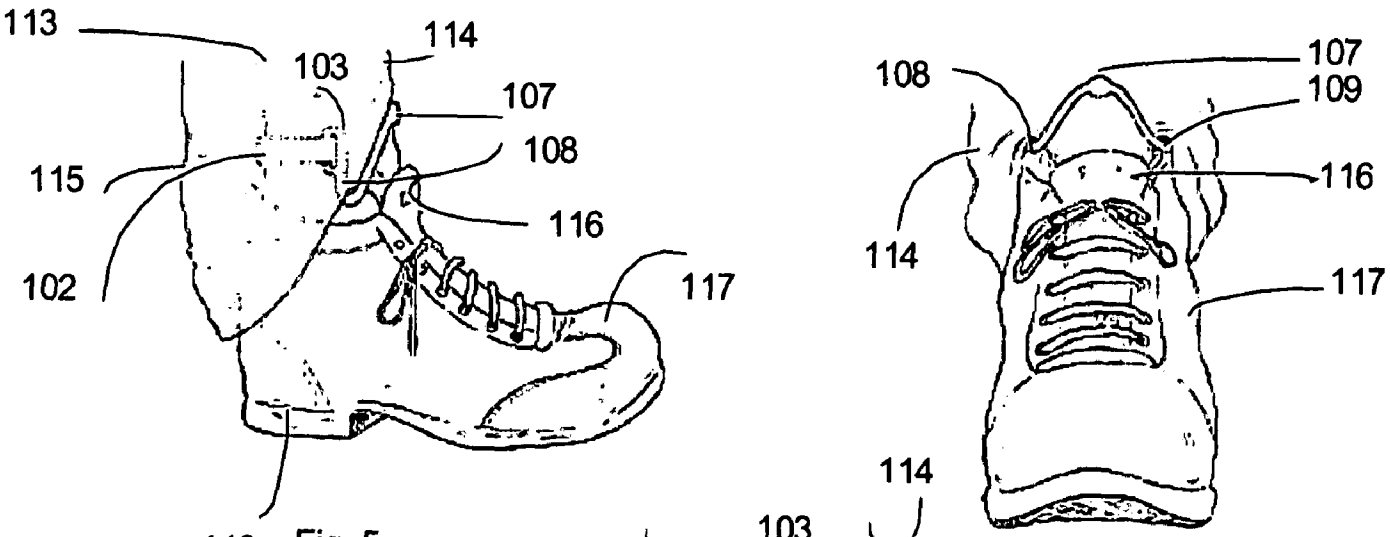
Fig. 5
Fig. 7
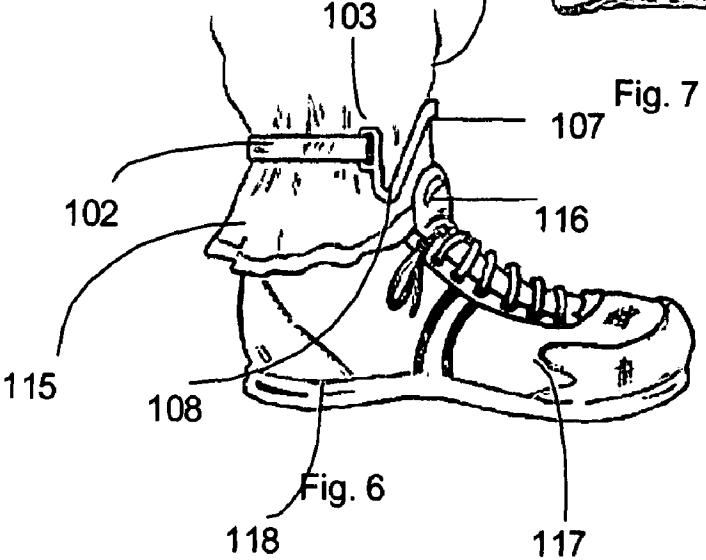
Fig. 6

J-BAND APPARATUS

RELATED APPLICATIONS

This application claims the benefit of U.S. Provisional Application 60/642,017, filed Jan. 7, 2005. This application is related to application Ser. No. 29/224,679 entitled "J-BANDS", filed Mar. 3, 2005. These above applications are incorporated herein by reference in their entirety.

BACKGROUND OF THE INVENTION

People have used rubber bands, strings and the like for years to hold their pant legs in place, whether to hold their pant legs off the ground, out of the way to allow riding a bike without a chain guard or to help keep the pant legs up to prevent the shoes or boots from staining the pant legs. This presents an unsightly appearance to the viewing public.

There is therefore a need for a device or apparatus that will perform this function while providing a colorful style in different sizes without having the person present an unsightly appearance. Such an apparatus has to be simple to use, and be an accessory to the style of clothing a person may wear. Therefore, to meet this style requirement there is a need for an improved apparatus for providing this style requirement.

BRIEF SUMMARY OF THE INVENTION

The J-Band is a pant accessory that allows the person to display the tongue of his or her boot or shoe. The J-Band can also be worn over the entire pant legs, to prevent long pants from dragging under a heel of the shoe. A company logo may be placed or engraved on the center portion of the J-Band or along the bar. The advantage of the J-Band over the use of rubber bands and the like is that the J-Band allows the person to add to their style rather than detract from it.

In an aspect, the J-Band supports the ankle-shin area of pant legs. The J-Band has a "W" shaped bar with a first loop and a second loop on each end. A strap has each end connected to each loop respectively. The strap has an adjustment buckle coupled to it for adjusting the tension on the strap, thereby allowing tightening and loosing of the J-Band against the leg of the person.

Additional embodiments and advantages of the present invention will become apparent from the following description and the appended claims when considered with the accompanying drawing.

BRIEF DESCRIPTION OF THE DRAWINGS

FIG. 5 shows a side-view perspective of a J-Band 100 of FIG. 1 in use, according to the present invention;

FIG. 6 shows a side-view perspective of a J-Band 100 of FIG. 1 in another use, according to the present invention; and, FIG. 7 shows a front view perspective of a J-band in use, according to the present invention.

DETAILED DESCRIPTION OF THE INVENTION

Figure 1:
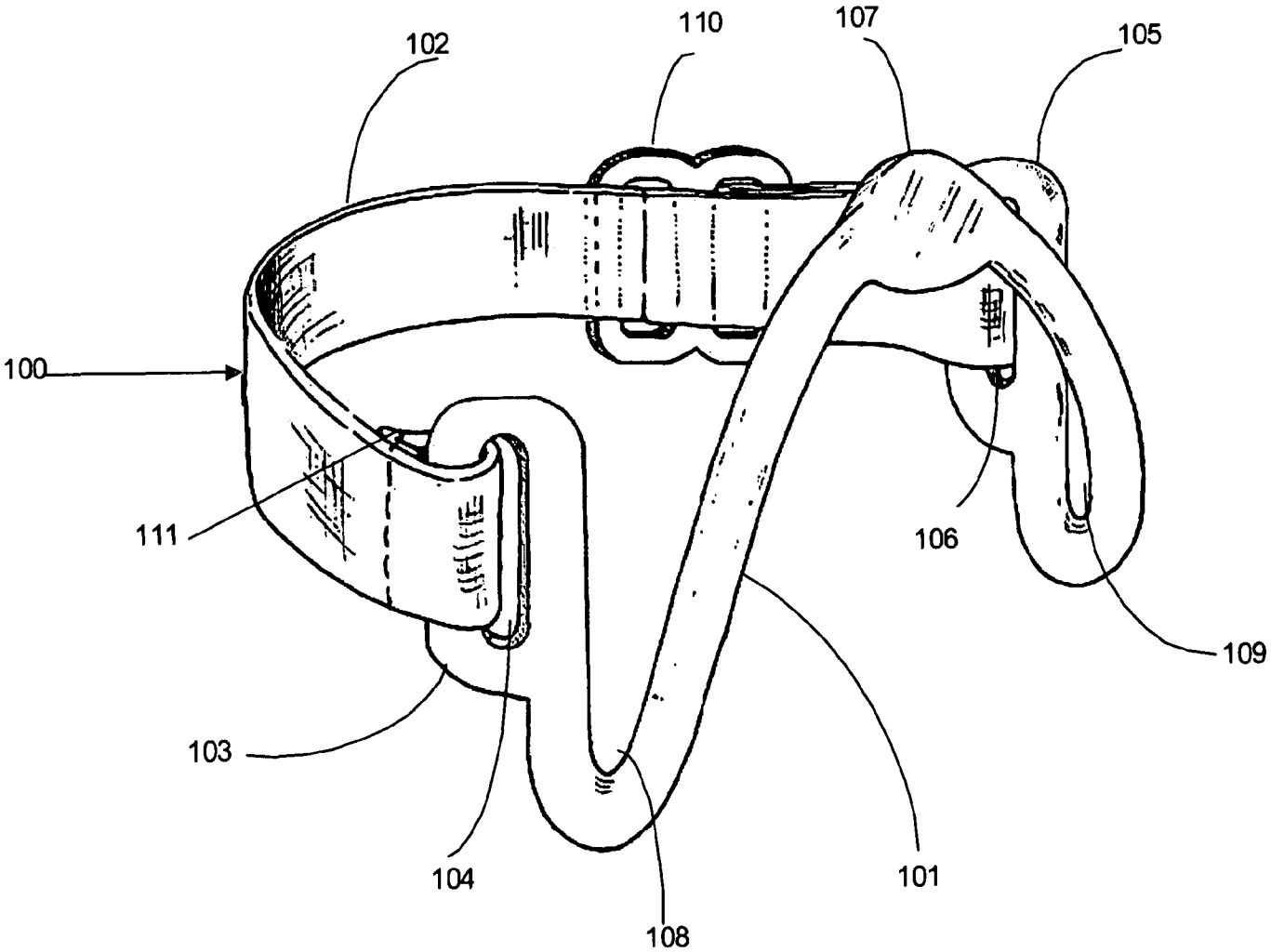
FIG. 1 shows a cross-sectional view of an embodiment of a J-Band, according to the present invention.
Figure 2:
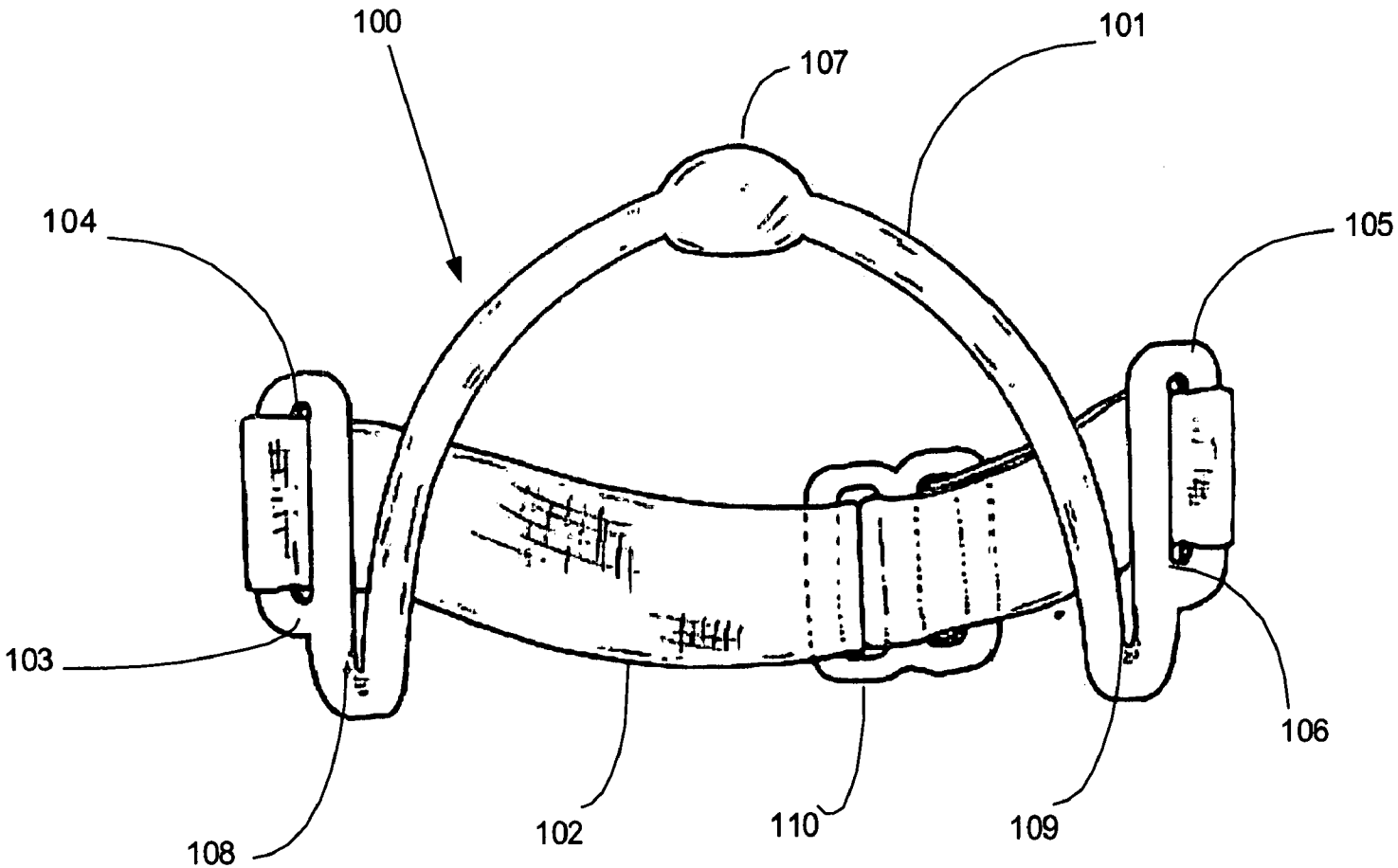
FIG. 2 shows a perspective front view of a J-Band of FIG. 1, according to the present invention.

FIG. 1 shows a perspective view of a J-Band 100, according to the present invention. FIG. 2 shows a perspective front view of a J-Band, according to the present invention. The J-Band 100 includes a bar 101 and a strap 102.

The bar 101 includes a loop 103 having a loop hole 104, and loop 105 having a loop hole 106. In the present invention, bar 101 is cast in a "W" shape having a center portion 107 and an interior elbow 108 and an interior elbow 109. Typically, the center portion 107 is cast in such a way as to accommodate a decal, such as, a manufacture's decal or sport decal and the like. Likewise, the decals may be placed on the sides of the bar 101 or the strap 102. Typically, the bar 101 is made of harden plastic but may be made of rubber, metal or the like.

The strap 102 includes an adjustment buckle 110. Typically, strap 102 is made of an elastic material but it may be made of rubber or a non-elastic material. In the present invention, the adjustment buckle 110 is made of plastic but may also be made of metal or be formed by using a Velcro assembly (not shown), which is known in the art. How the J-Band 100 is assembled will be discussed next.

Figure 4:
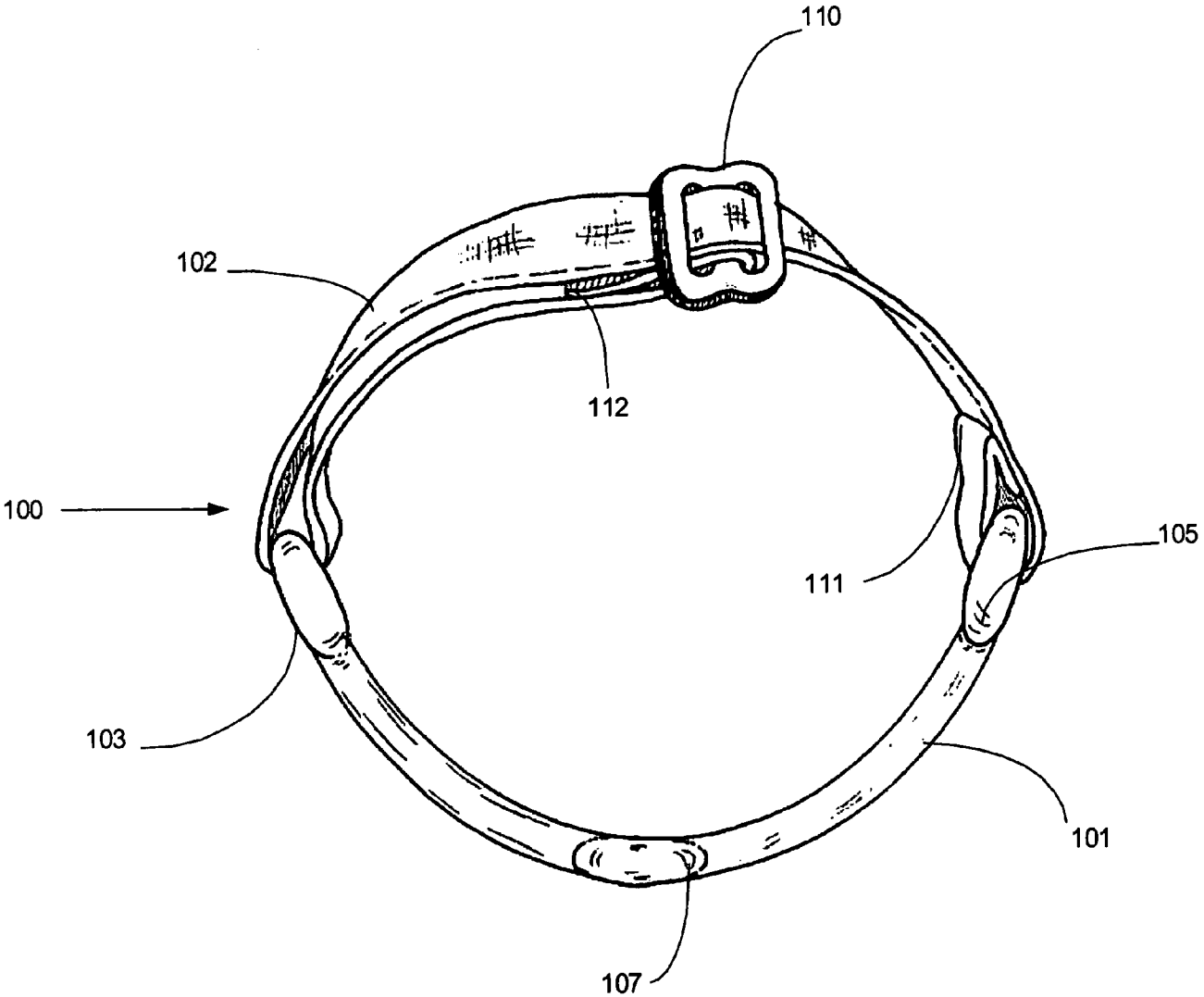
FIG. 4 shows a perspective top view of a J-Band of FIG. 1, according to the present invention.

As stated above, the bar 101 has a loop 103 having a loop hole 104, and loop 105 having a loop hole 106. Loop holes 104 and 106 are cast to accommodate Strap 102. Strap 102 has an end 111 that is threaded through loop hole 104 and then attached to strap 102. Typically, end 111 is attached to strap 102 by sewing it to strap 102. Another end 112 of strap 102 is threaded through loop hole 106 and then through the adjustment buckle 110, by a method known in the art, and then attached to strap 102. Typically, end 112 is attached to strap 102 by sewing it to strap 102, as shown in FIG. 4.

Figure 3:
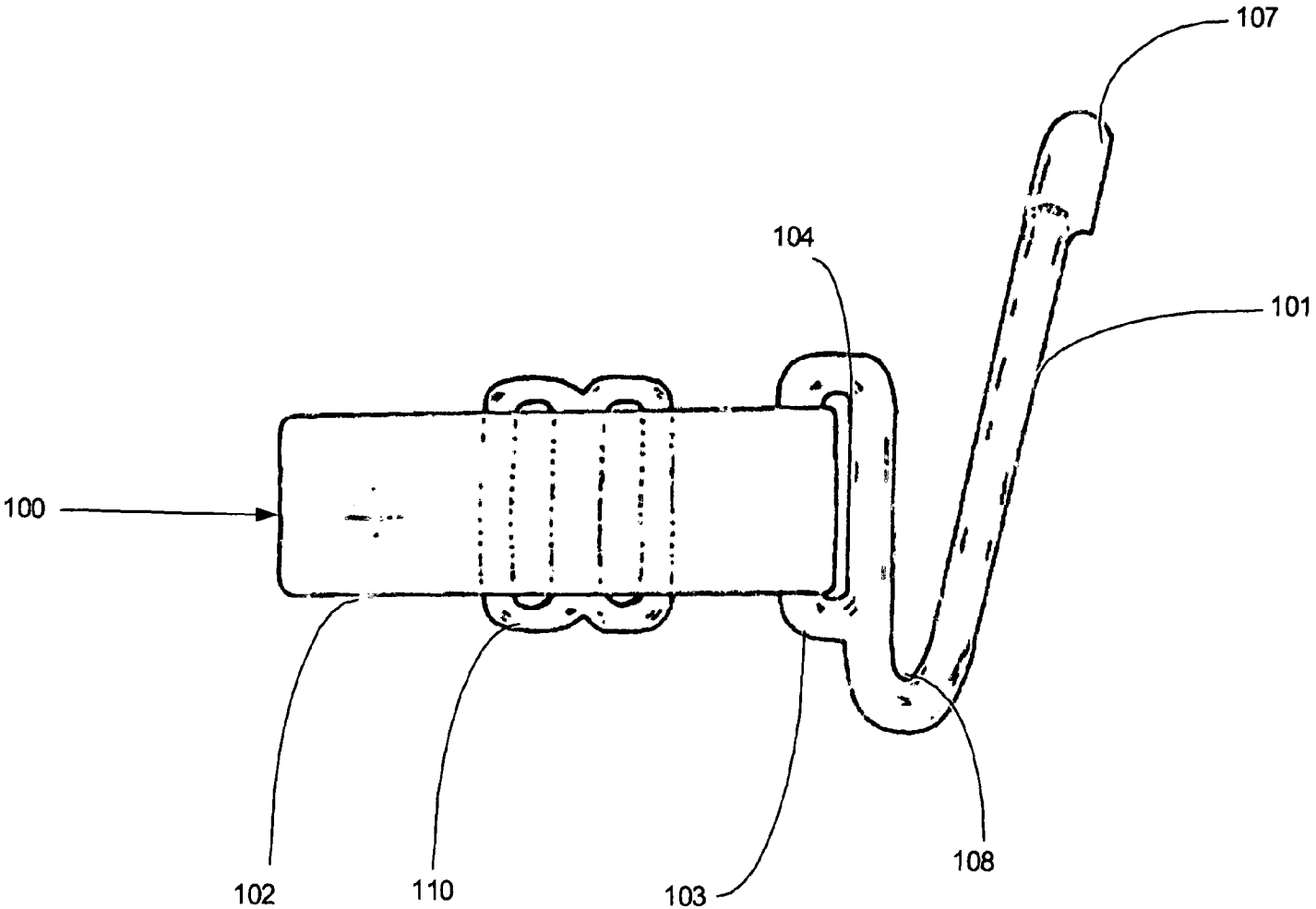
FIG. 3 shows a perspective side view of a J-Band of FIG. 1, according to the present invention.

FIG. 3 shows a perspective side view of a J-Band, according to the present invention. Center portion 107 angles away from interior elbows 108, 109 (not shown) and loops 103, 105 (not shown).

FIG. 5 shows a side-view perspective of a J-Band 100 in use, according to the present invention. FIG. 7 shows a front view perspective of a J-band in use, according to the present invention. As shown in theses views a person may place the strap 102 of J-Band 100 directly against a leg 113 and then place a front of a pant leg 114 on the interior elbows 108, 109 and behind center portion 107. The person may also place a front portion 114 of the pant legs 115 in front (not shown) or behind a tongue 116 of a shoe 117. By wearing the J-Band 100 in this way the person only shows the center portion 107 and the interior elbows 108, 109 and is also allowed a freedom of style in what is displayed to the public.

FIG. 6 shows a side-view perspective of a J-Band 100 in another use, according to the present invention. The person may also place the strap 102 of the J-Band 100 on the out side of a pant leg 115. Used in this way, the J-Band 100 is completely visible. The person may also place a front portion 114 of the pant legs 115 in front (not shown) or behind the tongue 116 of the shoe 117.

The J-Band 100 is a pant accessory that allows the person to display the tongue 116 of his or her shoe 117. The J-Band can also be worn over the entire pant legs 115, to prevent long pants from dragging under a heel 118 of the shoe 117. A company logo may be placed or engraved on the center portion 107 or along the bar 101.

The foregoing detailed description is merely illustrative of several physical embodiments of the invention. Physical variations of the invention, not fully described in the specification, may be encompassed within the purview of the claims. Accordingly, any narrower description of the elements in the specification should be used for general guidance, rather than to unduly restrict any broader descriptions of the elements in the following claims.

We claim:

1. An apparatus for supporting an ankle-shin area of a pant leg, comprising:

a substantially rigid W-shaped bar comprising a first end loop and a second end loop;

a resilient strap comprising a first strap end connected to said first end loop of said bar;

a second strap end of the resilient strap connected to said second end loop of said bar; and and an adjustable buckle coupled to said strap, wherein said adjustable buckle is adjusted along the strap so said strap expands or contracts to fit around said pant leg, wherein the first and second strap ends of said strap are non-detachable and permanently fixed about the first and second loop, respectively; wherein the apparatus is positioned substantially about a lower region of the pant leg.

2. The apparatus of claim 1, wherein said bar is made of metal.

3. The apparatus of claim 1, wherein said bar is made of plastic.

4. The apparatus of claim 1, wherein said bar is made of rubber.

5. The apparatus of claim 1, wherein said adjustable buckle comprises a hook and loop material assembly.

6. The apparatus of claim 1, wherein said strap is made of rubber.

* * * * *